US008047810B2

(12) United States Patent
Sugiura et al.

(10) Patent No.: US 8,047,810 B2
(45) Date of Patent: Nov. 1, 2011

(54) DOUBLE-HEADED PISTON TYPE COMPRESSOR

(75) Inventors: Manabu Sugiura, Kariya (JP); Akio Saiki, Kariya (JP); Norikazu Deto, Kariya (JP); Kazuhiro Hotta, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 947 days.

(21) Appl. No.: 12/021,831

(22) Filed: Jan. 29, 2008

(65) Prior Publication Data

US 2008/0286125 A1 Nov. 20, 2008

(30) Foreign Application Priority Data

Feb. 2, 2007 (JP) ..... 2007-024271

(51) Int. Cl.
*F04B 1/12* (2006.01)
*F04B 7/00* (2006.01)
*F01B 3/00* (2006.01)

(52) U.S. Cl. ..... 417/269; 417/512; 92/71

(58) Field of Classification Search ..... 417/269, 417/512; 92/71
See application file for complete search history.

(56) References Cited

U.S. PATENT DOCUMENTS 5,380,163 A * 1/1995 Fujii et al. ..... 417/242
5,478,212 A * 12/1995 Sakai et al. ..... 417/269
5,533,872 A * 7/1996 Fujii et al. ..... 417/269
5,549,453 A * 8/1996 Murakami et al. ..... 417/269
5,551,844 A * 9/1996 Fujii et al. ..... 417/269
5,562,425 A * 10/1996 Kimura et al. ..... 417/269
6,257,848 B1 7/2001 Terauchi
6,862,975 B2 * 3/2005 Shintoku et al. ..... 92/154
7,172,393 B2 2/2007 Adams et al.
2008/0298980 A1 * 12/2008 Lim et al. ..... 417/269

FOREIGN PATENT DOCUMENTS

JP 62-195680 U 12/1987
JP 5-164044 A 6/1993
JP 5-306680 A 11/1993
JP 6-117363 A 4/1994
JP 07-286579 A 10/1995

(Continued)

OTHER PUBLICATIONS

English Summary of JP Notice of Allowance mailed on Mar. 22, 2011 corresponding to JP Application No. 2007-024271.

*Primary Examiner* — Charles Freay
(74) *Attorney, Agent, or Firm* — Knoble Yoshida & Dunleavy, LLC

(57) ABSTRACT

A double-headed piston type compressor connected with an external device is provided. The compressor includes a plurality of cylinder bore pairs, double-headed pistons, a first rotary valve, a second rotary valve, first suction passages, and second suction passages. In each cylinder bore pair, a first time period from a first top dead center timing, which is timing when the double-headed piston reaches a top dead center in a first compression chamber, to a first communication start timing, which is timing when a first introduction passage starts to communicate with a first suction passage, is different from a second time period from a second top dead center timing, which is timing when the double-headed piston reaches a top dead center in a second compression chamber, to a second communication start timing, which is timing when the second introduction passage starts to communicate with a second suction passages.

10 Claims, 7 Drawing Sheets

FOREIGN PATENT DOCUMENTS

| | | | |
|---|---|---|---|
| JP | 2000-161217 | A | 6/2000 |
| JP | 2001-193645 | A | 7/2001 |
| JP | 2002-070728 | A | 3/2002 |
| JP | 2002-155856 | A | 5/2002 |
| JP | 2002-235660 | A | 8/2002 |
| JP | 2003-021057 | A | 1/2003 |
| JP | 2003-222075 | A | 8/2003 |
| JP | 2004-225557 | A | 8/2004 |
| JP | 2005-140019 | A | 6/2005 |
| JP | 2006-037892 | A | 2/2006 |
| JP | 2002-005025 | A | 1/2008 |

* cited by examiner

DOUBLE-HEADED PISTON TYPE COMPRESSOR

BACKGROUND OF THE INVENTION

The present invention relates to a double-headed piston type compressor provided with rotary valves on both ends of a rotary shaft.

As a vehicle air-conditioning compressor, a double-headed piston type compressor has been in use, for example. In the compressor of this kind, each of a plurality of double-headed pistons is housed in a pair of front and rear cylinder bores. A housing of the compressor has a swash plate chamber for accommodating a swash plate which rotates with a rotary shaft. Rotation of the swash plate reciprocates the double-headed pistons within the cylinder bores. The double-headed piston defines a compression chambers in the cylinder bore. Along with the reciprocation, the double-headed piston draws refrigerant into the compression chambers via a refrigerant suction system. The double-headed piston also compresses the refrigerant in the compression chambers and then discharges the refrigerant to discharge chambers.

The refrigerant having been discharged into the discharge chambers is delivered to an external refrigerant circuit via piping. The refrigerant having passed through the external refrigerant circuit is sent back to the compressor via piping. Japanese Laid-Open Patent Publication No. 5-306680 discloses a refrigerant suction system allowing a refrigerant to be drawn from a swash plate chamber to a compression chamber via a rotary valve. Japanese Laid-Open Patent Publication No. 2003-222075 discloses a refrigerant suction system allowing a refrigerant to be drawn from a suction chamber formed in a housing of a compressor to a compression chamber via a rotary valve.

In the compressors disclosed in the above-mentioned Japanese Laid-Open Patent Publication No. 5-306680 and Japanese Laid-Open Patent Publication No. 2003-222075, however, pulsations (pressure fluctuations) are caused when the refrigerant is drawn into the compression chambers via the rotary valve. The pulsations resonate an external device such as the piping or the external refrigerant circuit, whereupon noise can be caused in a passenger compartment.

SUMMARY OF THE INVENTION

Accordingly, it is an objective of the present invention to provide a double-headed piston type compressor having a rotary valve, capable of suppressing the occurrence of a resonant phenomenon in an external device due to pulsations caused when refrigerant is drawn into each of the compression chambers and thereupon controlling noise.

To achieve the foregoing objective and in accordance with one aspect of the present invention, a double-headed piston type compressor connected with an external device so as to constitute a refrigerant circuit is provided. The compression includes a rotary shaft, a compressor housing, double-headed pistons, a swash plate, a first rotary valve, a second rotary valve, first suction passages, and second suction passages. The rotary shaft has a first end portion and a second end portion. The compressor housing is connected with the external device. The compressor housing has a front portion rotatably supporting the first end portion of the rotary shaft, a rear portion rotatably supporting the second end portion of the rotary shaft, a swash plate chamber, a suction pressure zone communicating with the external device, and a plurality of cylinder bore pairs arranged around the rotary shaft. Each of the cylinder bore pairs has a front cylinder bore and a rear cylinder bore. The double-headed pistons are inserted into the plurality of cylinder bore pairs respectively so as to reciprocate. Each of the double-headed pistons defines a first compression chamber within the front cylinder bore and a second compression chamber within the rear cylinder bore. The swash plate rotates with the rotary shaft within the swash plate chamber and causing the double-headed pistons to reciprocate within the cylinder bore pairs. The first rotary valve is coupled with the rotary shaft so as to be rotatable with the rotary shaft integrally, and has a first introduction passage for introducing a refrigerant from the suction pressure zone into the first compression chambers. The second rotary valve is coupled with the rotary shaft so as to be rotatable with the rotary shaft integrally, and has a second introduction passage for introducing a refrigerant from the suction pressure zone into the second compression chambers. The first suction passages are formed in the compressor housing so as to allow each of the first compression chambers to be connected with the first introduction passage. The second suction passages are formed in the compressor housing so as to allow each of the second compression chambers to be connected with the second introduction passage. In each cylinder bore pair, a first time period from a first top dead center timing, which is timing when the double-headed piston reaches the top dead center in the first compression chamber, to a first communication start timing, which is timing when the first introduction passage starts to communicate with the first suction passage, is different from a second time period from a second top dead center timing, which is timing when the double-headed piston reaches the top dead center in the second compression chamber, to a second communication start timing, which is timing when the second introduction passage starts to communicate with the second suction passages.

In accordance with another aspect of the present invention, a double-headed piston type compressor connected with an external device so as to constitute a refrigerant circuit is provided. The compression includes a rotary shaft, a compressor housing, double-headed pistons, a swash plate, a first rotary valve, a second rotary valve, first suction passages, and second suction passages. The rotary shaft has a first end portion and a second end portion. The compressor housing is connected with the external device. The compressor housing has a front portion rotatably supporting the first end portion of the rotary shaft, a rear portion rotatably supporting the second end portion of the rotary shaft, a swash plate chamber, a suction pressure zone communicating with the external device, and a plurality of cylinder bore pairs arranged around the rotary shaft. Each of the cylinder bore pairs has a front cylinder bore and a rear cylinder bore. The double-headed pistons are inserted into the plurality of cylinder bore pairs respectively so as to reciprocate. Each of the double-headed pistons defines a first compression chamber within the front cylinder bore and a second compression chamber within the rear cylinder bore. The swash plate rotates with the rotary shaft within the swash plate chamber and causing the double-headed pistons to reciprocate within the cylinder bore pairs. The first rotary valve is coupled with the rotary shaft so as to be rotatable with the rotary shaft integrally, and has a first introduction passage for introducing a refrigerant from the suction pressure zone into the first compression chambers. The second rotary valve is coupled with the rotary shaft so as to be rotatable with the rotary shaft integrally, and has a second introduction passage for introducing a refrigerant from the suction pressure zone into the second compression chambers. The first suction passages are formed in the compressor housing so as to allow each of the first compression chambers to be connected with the first introduction passage.

The second suction passages are formed in the compressor housing so as to allow each of the second compression chambers to be connected with the second introduction passage. In each cylinder bore pair, a range of rotation angle at which the rotary shaft rotates from when the double-headed piston reaches the top dead center in the first compression chamber to when the first introduction passage starts to communicate with the first suction passage is different from a range of rotation angle at which the rotary shaft rotates from when the double-headed piston reaches the top dead center in the second compression chamber to when the second introduction passage starts to communicate with the second suction passage.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
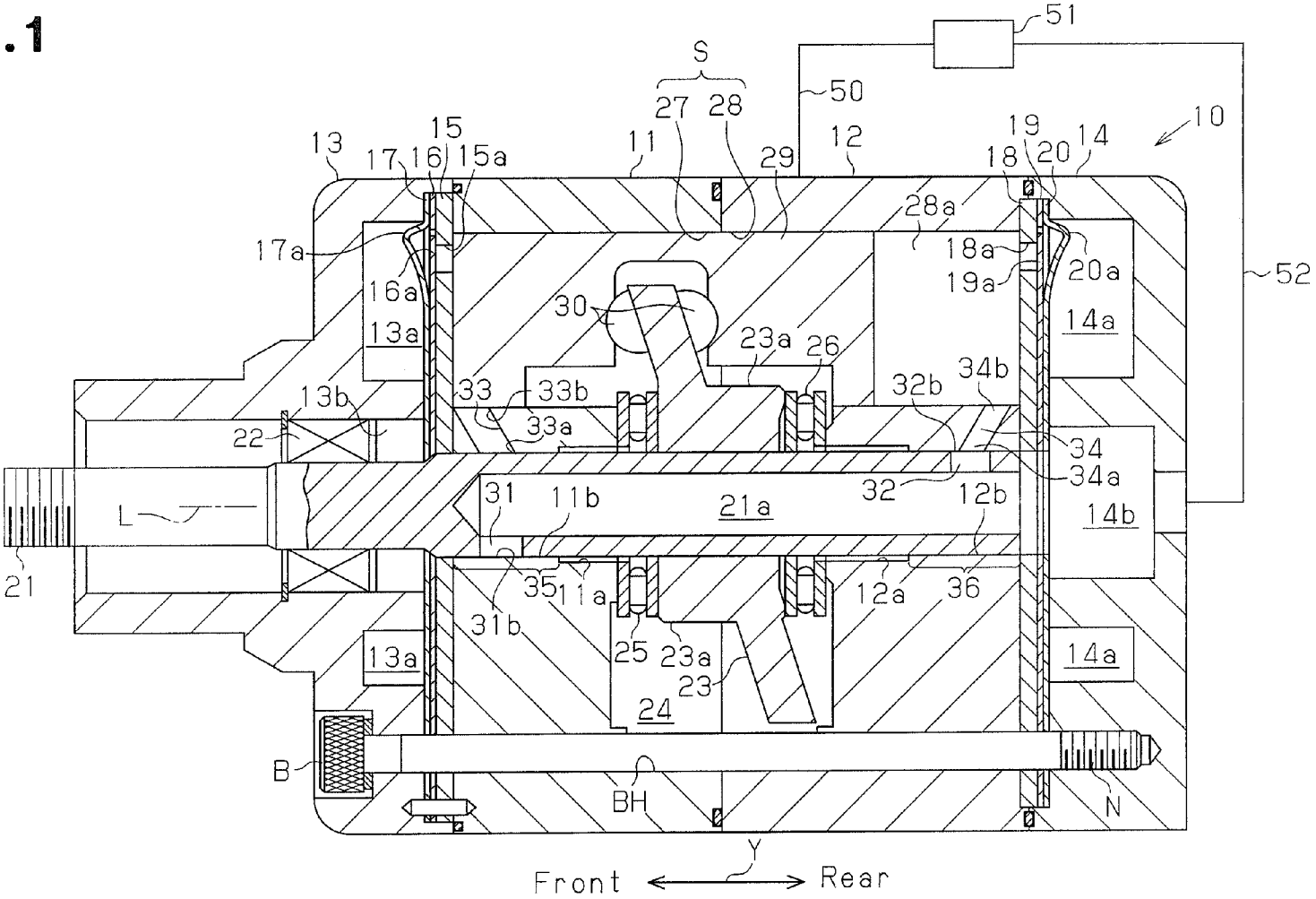
FIG. 1 is a longitudinal cross-sectional view of a double-headed piston type compressor in accordance with a first embodiment of the present invention.

Hereinafter, a first embodiment of the double-headed piston type compressor embodying the present invention is described with reference to FIGS. 1 to 9. FIG. 1 illustrates a longitudinal cross-sectional view of a double-headed piston type compressor (hereinafter, referred to as a compressor) 10 of the first embodiment. In the following description, the front and the rear of the compressor 10 correspond to double-headed arrow Y shown in FIG. 1.

As shown in FIG. 1, a housing (a compressor housing) of the compressor 10 includes a pair of front and rear cylinder blocks 11 and 12 both of which are joined to each other, the front cylinder block 11 having a front end joined with a front housing member 13, the rear cylinder block 12 having a rear end joined with a rear housing member 14. The cylinder blocks 11 and 12, the front housing member 13 and the rear housing member 14 are fastened together by a plurality (five, for example) of bolts B. Each bolt B is inserted through a bolt through hole BH formed in the cylinder blocks 11 and 12, the front housing member 13 and the rear housing member 14. A thread portion N formed in a distal end of each bolt B is threadedly engaged with the rear housing member 14.

A valve plate 15, a valve flap plate 16, and a retainer plate 17 are arranged between the front housing member 13 and the front cylinder block 11. A valve plate 18, a valve flap plate 19, and a retainer plate 20 are arranged between the rear housing member 14 and the rear cylinder block 12. Each valve plate 15, 18 has a plurality of discharge ports 15*a*, 18*a*. Each valve flap plate 16, 19 has a plurality of discharge valve flaps 16*a*, 19*a* corresponding to the discharge ports 15*a*, 18*a*, respectively. Each discharge valve flap 16*a*, 19*a* opens and closes its corresponding discharge port 15*a*, 18*a*. Each retainer plate 17, 20 has a plurality of retainers 17*a*, 20*a* corresponding to the discharge valve flaps 16*a*, 19*a*, respectively. Each retainer 17*a*, 20*a* restricts the opening degree of the corresponding discharge valve flap 16*a*, 19*a*.

A discharge chamber 13*a* is formed between the front housing member 13 and the valve plate 15, whereas a discharge chamber 14*a* and a suction chamber 14*b* are formed between the rear housing member 14 and the valve plate 18. A refrigerant having been discharged into the discharge chambers 13*a* and 14*a* is delivered from a communication port (not shown) which communicates with the discharge chambers 13*a* and 14*a*, into an external refrigerant circuit 51 via piping 50 which is connected to the communication port. The refrigerant is introduced from the external refrigerant circuit 51 into the suction chamber 14*b* via piping 52. The external refrigerant circuit 51 includes devices such as a condenser, an evaporator and the like. The piping 50 and 52 and the external refrigerant circuit 51 constitute an external device connected to the compressor housing. The compressor 10, the piping 50 and 52 and the external refrigerant circuit 51 form a refrigerant circuit.

A rotary shaft 21 is rotatably supported in the cylinder blocks 11 and 12. The rotary shaft 21 has a front portion (a first end portion) corresponding to a front portion of the compressor housing and a rear portion (a second end portion) corresponding to a rear portion of the compressor housing in a direction along the central axis L thereof. The first end portion of the rotary shaft 21 is inserted through a front shaft hole 11*a* formed in the front cylinder block 11. The second end portion of the rotary shaft 21 is inserted through a rear shaft hole 12*a* formed in the rear cylinder block 12. The first end portion of the rotary shaft 21 is rotatably supported by a circumferential surface of the front shaft hole 11*a*, that is, the front cylinder block 11. The second end portion of the rotary shaft 21 is rotatably supported by a circumferential surface of the rear shaft hole 12*a*, that is, the rear cylinder block 12. Between the front housing member 13 and the rotary shaft 21, a lip type shaft sealing device 22 is provided. The shaft sealing device 22 is housed within a storage chamber 13*b* formed in the front housing member 13. The front discharge chamber 13*a* is provided around the storage chamber 13*b*.

The rotary shaft 21 is fixed with a swash plate 23 rotating therewith. The swash plate 23 is arranged between the pair of cylinder blocks 11 and 12 or in a swash plate chamber 24 defined within the compressor housing. A thrust bearing 25 is provided between an end face of the front cylinder block 11 and an annular base 23*a* of the swash plate 23. A thrust bearing 26 is provided between an end face of the rear cylinder block 12 and the base 23*a* of the swash plate 23. The thrust bearings 25 and 26 sandwich the swash plate 23 so as to restrict the movement of the rotary shaft 21 along the direction of the central axis L.

A plurality of front cylinder bores (first cylinder bores) 27 (five cylinder bores in the first embodiment) are formed in the front cylinder block 11 so as to be arranged in the periphery of the central axis L of the rotary shaft 21, although only one cylinder bore 27 is shown in FIG. 1. A plurality of rear cylinder bores (second cylinder bores) 28 (five cylinder bores in the first embodiment) are formed in the rear cylinder block 12 so as to be arranged in the periphery of the central axis L of the rotary shaft 21, although only one cylinder bore 28 is shown in FIG. 1. Each front cylinder bore 27 and a rear cylinder bore 28 corresponding to the former constitute a cylinder bore pair S. A double-headed piston 29 is inserted in each cylinder bore pair S so as to reciprocate forward and rearward.

Figure 6A:
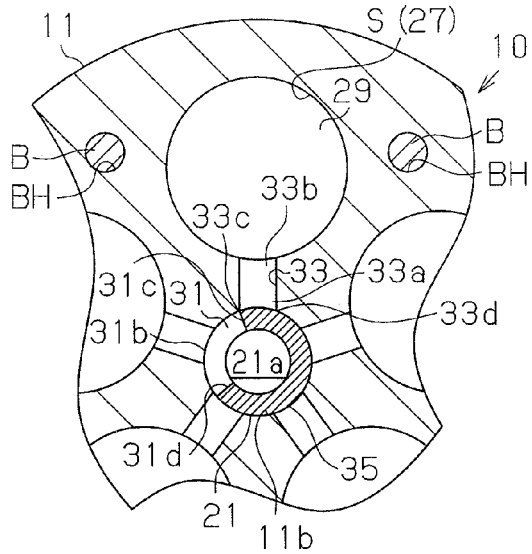
FIG. 6A is a longitudinal cross-sectional view of the first rotary valve when the double-headed piston is rotated by a predetermined angle from the top dead center in FIG. 5A.
Figure 6B:
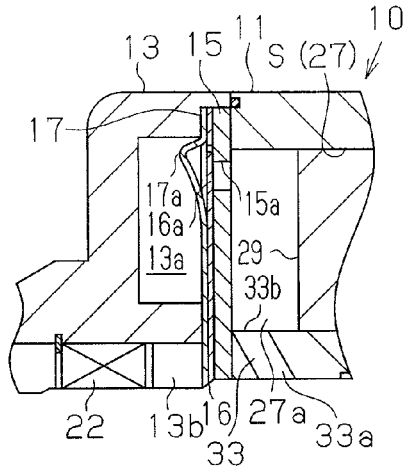
FIG. 6B is a transverse cross-sectional view of FIG. 6A.

Rotational movement of the swash plate 23 which integrally rotates with the rotary shaft 21 is transmitted to each double-headed piston 29 via a pair of shoes 30 provided so as to sandwich the swash plate 23, whereupon the double-headed piston 29 reciprocates inside the corresponding cylinder bore pair S. As shown in FIG. 6B, a first compression chamber 27*a* is formed by the front valve plate 15 and the double-headed piston 29 in each front cylinder bore 27. A second compression chamber 28*a* is formed by the rear valve plate 18 and the double-headed piston 29 in each rear cylinder bore 28, as shown in FIG. 1. The position of the double-headed piston 29 when the volume of the first compression chamber 27*a* is maximum is defined as the bottom dead center of the double-headed piston 29 in the first compression chamber 27*a*. The position of the double-headed piston 29 when the volume of the first compression chamber 27*a* is minimum is defined as the top dead center of the double-headed piston 29 in the first compression chamber 27*a*. The position of the double-headed piston 29 when the volume of the second compression chamber 28*a* is maximum is defined as the bottom dead center of the double-headed piston 29 in the second compression chamber 28*a*. The position of the double-headed piston 29 when the volume of the second compression chamber 28*a* is minimum is defined as the top dead center of the double-headed piston 29 in the second compression chamber 28*a*.

On an inner circumferential surface of the shaft holes 11*a* and 12*a* through which the rotary shaft 21 is inserted, seal portions 11*b* and 12*b* sealing an outer circumferential surface of the rotary shaft 21 and the inner circumferential surface of the shaft holes 11*a* and 12*a* are formed. The rotary shaft 21 is directly supported by the cylinder blocks 11 and 12 via the seal portions 11*b* and 12*b*. The rotary shaft 21 is provided with a shaft passage 21*a*. A rear end of the shaft passage 21*a* communicates with the suction chamber 14*b*. The suction chamber 14*b* and the shaft passage 21*a* constitute a suction pressure zone.

The rotary shaft 21 has a first introduction passage 31 in a position corresponding to the front cylinder block 11. The first introduction passage 31 communicates with the shaft passage 21*a* and opens toward the outer circumferential surface of the rotary shaft 21. The rotary shaft 21 also has a second introduction passage 32 in a position corresponding to the rear cylinder block 12. The second introduction passage 32 communicates with the shaft passage 21*a* and opens toward the outer circumferential surface of the rotary shaft 21. A part of the first introduction passage 31 which opens toward the outer circumferential surface of the rotary shaft 21 is a refrigerant outlet 31*b*. A part of the second introduction passage 32 which opens toward the outer circumferential surface of the rotary shaft 21 is a refrigerant outlet 32*b*.

Figure 2:
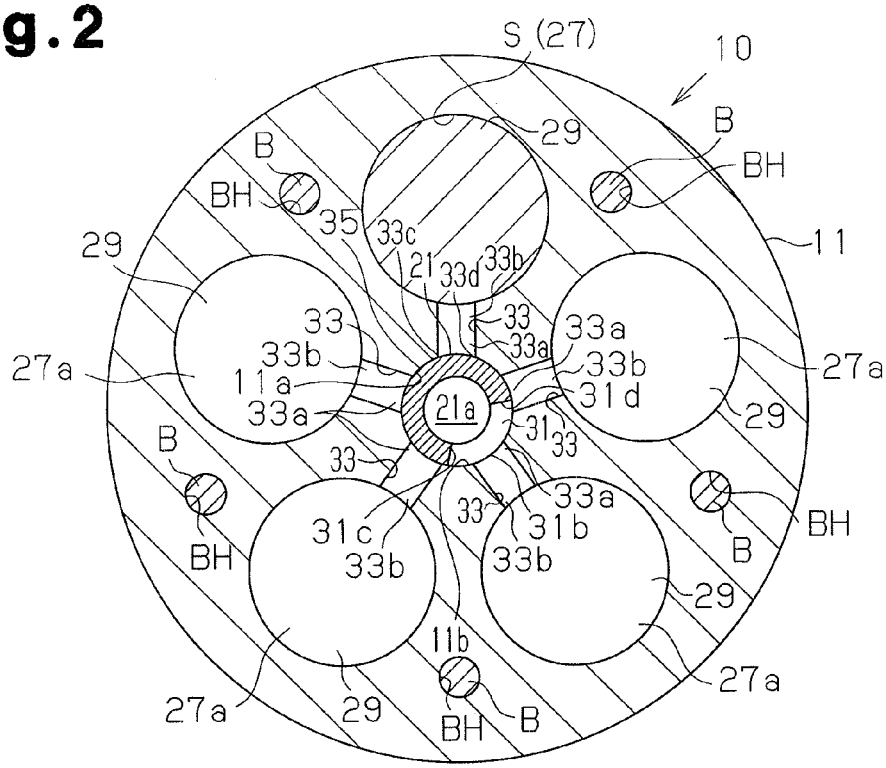
FIG. 2 is a cross-sectional view of a front cylinder block and a first rotary valve in the compressor shown in FIG. 1.
Figure 3:
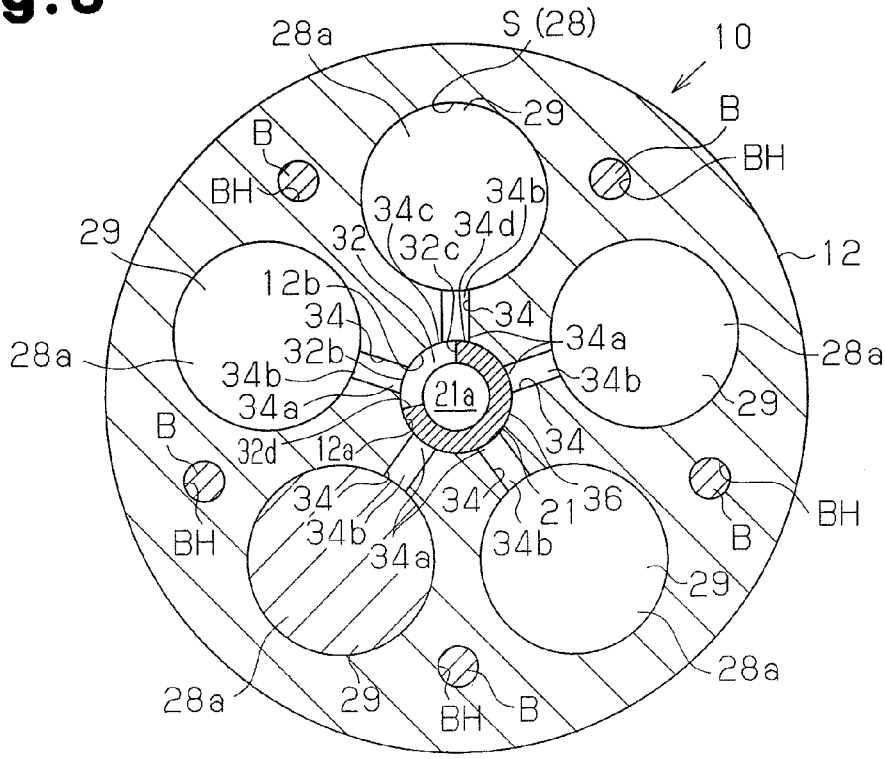
FIG. 3 is a cross-sectional view of a rear cylinder block and a second rotary valve in the compressor shown in FIG. 1.

As shown in FIG. 2, five first suction passages 33 are formed in the front cylinder block 11 so as to connect the front cylinder bores 27 with the shaft hole 11*a*, respectively. Each first suction passage 33 has an inlet 33*a* opening on the seal portion 11*b* and an outlet 33*b* opening on the inner circumferential surface of the front cylinder bore 27. As shown in FIG. 3, five second suction passages 34 are formed in the rear cylinder block 12 so as to connect the rear cylinder bores 28 with the shaft hole 12*a*, respectively. Each second suction passage 34 has an inlet 34*a* opening on the seal portion 12*b* and an outlet 34*b* opening on the inner circumferential surface of the rear cylinder bore 28. A diameter (cross-sectional area) of the first suction passage 33 is larger than that of the second suction passage 34.

As shown in FIG. 1, the outlet 31*b* of the first introduction passage 31 is formed in a position of intermittently communicating with the inlet 33*a* of the first suction passage 33 along with a rotation of the rotary shaft 21. The outlet 32*b* of the second introduction passage 32 is formed in a position of intermittently communicating with the inlet 34*a* of the second suction passage 34 along with a rotation of the rotary shaft 21. A part of the rotary shaft 21 encompassed by the front seal portion 11*b* constitutes a first rotary valve 35. A part of the rotary shaft 21 encompassed by the rear seal portion 12*b* constitutes a second rotary valve 36.

Next, the first rotary valve 35 and the second rotary valve 36 are described in detail. In the following, an explanation is given focusing on the relationship between the rotary valves 35 and 36 relative to one cylinder bore pair S.

Figure 4:
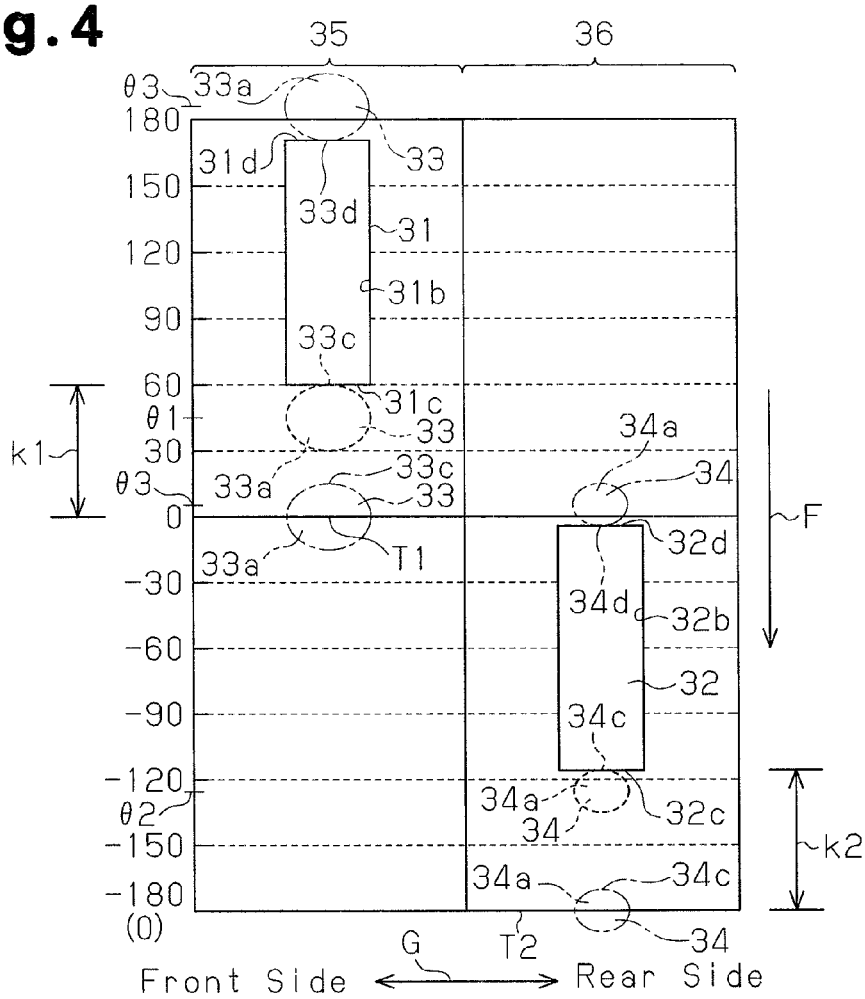
FIG. 4 is a diagram two-dimensionally developing an outer circumferential surface of the first and second rotary valves in the compressor shown in FIG. 1.

FIG. 4 is a schematic diagram two-dimensionally developing an outer circumferential surface portion of the rotary shaft 21 corresponding to the first rotary valve 35 and the second rotary valve 36. In FIG. 4, each of the inlets 33*a*, 34*a* of the suction passages 33, 34 communicating with one cylinder bore pair S is illustrated in a broken line, a chain line and a two-dot chain line. The inlets 33*a*, 34*a* are schematically brought into correspondence with the rotary valves 35, 36 in FIG. 4. That is, FIG. 4 illustrates a state where the inlet 33*a* of the first suction passage 33 is brought into correspondence with the first rotary valve 35 and also a state where the inlet 34*a* of the second suction passage 34 is brought into correspondence with the second rotary valve 36. The second rotary valve 36 is shown as being rotated 180 degrees relative to the first rotary valve 35 in FIG. 4. That is, the first rotary valve 35 and the second rotary valve 36 are shown with a rotation phase difference of 180 degrees.

When the double-headed piston 29 is at the position of the top dead center within the first compression chamber 27*a*, the inlet 33*a* of the first suction passage 33 is located in the position shown in the chain line relative to the outlet 31*b*. The broken line illustrates a position of the inlet 33*a* of the first suction passage 33 relative to the outlet 31*b* when the former starts to communicate with the latter. The two-dot chain line illustrates a position of the inlet 33*a* of the first suction passage 33 relative to the outlet 31*b* when the former finishes the communication with the latter.

On the other hand, the inlet 34*a* of the second suction passage 34 is located in a position shown in the chain line relative to the outlet 32*b* when the double-headed piston 29 is at the position of the top dead center within the second compression chamber 28*a*. The broken line illustrates a position of the inlet 34*a* of the second suction passage 34 relative to the outlet 32*b* when the former starts to communicate with the latter. The two-dot chain line illustrates a position of the inlet 34*a* of the second suction passage 34 relative to the outlet 32*b* when the former finishes the communication with the latter.

In FIG. 4, arrow F corresponds to a rotation direction of the rotary shaft 21 (both of the rotary valves 35, 36) and double-headed arrow G corresponds to a direction in which the central axis L of the rotary shaft 21 extends. One of both ends of the outlet 31*b* of the first introduction passage 31 in the rotation direction of the rotary shaft 21 is regarded as a communication start end 31*c* (first communication start end), at which communication with an end 33*c* of the inlet 33*a* of the first suction passage 33 is started first as the rotary shaft 21 rotates in the direction of arrow F. The other end is regarded as a communication finish end 31*d* (second communication start end), at which communication with the inlet 33*a* is finished after the communication start end 31*c*. One of both ends of the inlet 34*a* of the second introduction passage 32 in the rotation direction of the rotary shaft 21 is regarded as a communication start end 32*c* (first communication start end), at which communication with an end 34*c* of the inlet 34*a* of the second suction passage 34 is started first as the rotary shaft 21 rotates in the direction of arrow F. The other end is regarded as a communication finish end 32*d* (second communication start end), at which communication with the inlet 34*a* is finished after the communication start end 32*c*. The length from the communication start end 31*c* to the communication finish end 31*d* in the first introduction passage 31 along the circumferential direction of the rotary shaft 21 is greater than the length from the communication start end 32*c* to the communication finish end 32*d* in the second introduction passage 32 along the circumferential direction of the rotary shaft 21.

Figure 5A:
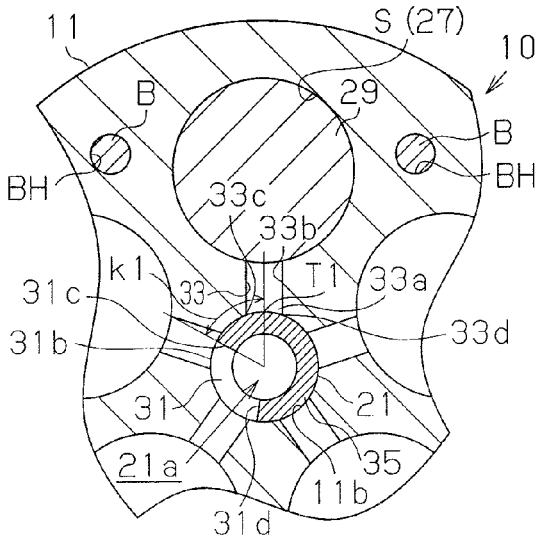
FIG. 5A is a longitudinal cross-sectional view of the first rotary valve when a double-headed piston is located at the top dead center in a first compression chamber in the compressor shown in FIG. 1.
Figure 5B:
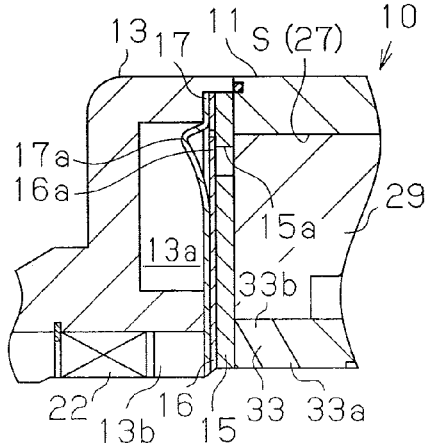
FIG. 5B is a transverse cross-sectional view of FIG. 5A.

In each cylinder bore pair S, the rotation angle of the rotary shaft 21 when the double-headed piston 29 is located at the top dead center within the first compression chamber 27*a* is regarded as being zero degrees, as shown in FIGS. 5A and 5B. The timing is defined as a top dead center timing (see FIG. 4). When the rotary shaft 21 rotates by an angle θ1 from when the double-headed piston 29 is at the position of the top dead center within the first compression chamber 27*a* (that is, when the rotation angle is zero degrees), the end 33*c* of the inlet 33*a* of the first suction passage 33 is matched with the communication start end 31*c* of the first introduction passage 31, as shown in FIG. 6A. At the matched timing, the first introduction passage 31 and the first suction passage 33 start to communicate with each other. The timing of the matching is defined as a communication start timing. The relationship between the inlet 33*a* and the outlet 31*b* shown in FIG. 6A corresponds to the relationship between the inlet 33*a* shown by the broken line and the outlet 31*b* in FIG. 4. At the communication start timing, residual gas is expanded within the first compression chamber 27*a*, wherewith a pressure within the first compression chamber 27*a* is not more than a pressure in the shaft passage 21*a* which is a suction pressure zone.

Figure 7A:
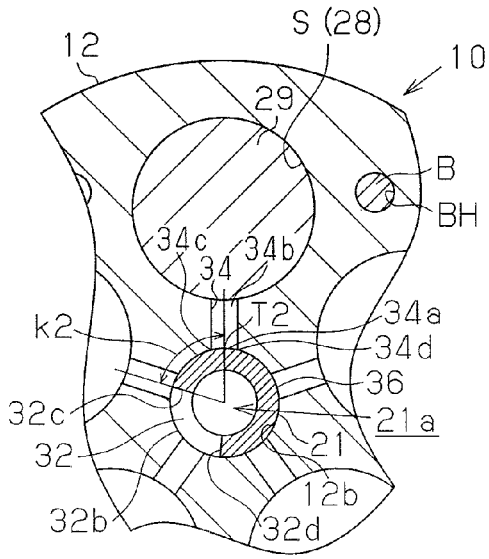
FIG. 7A is a longitudinal cross-sectional view of the second rotary valve when the double-headed piston is located at the top dead center in a second compression chamber.
Figure 7B:
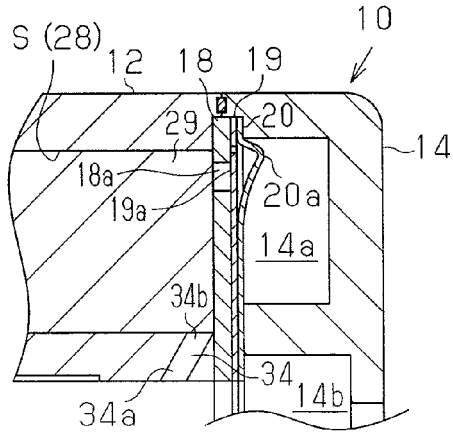
FIG. 7B is a transverse cross-sectional view of FIG. 7A.

When the rotary shaft 21 rotates 180 degrees from when the double-headed piston 29 is at the position of the top dead center within the first compression chamber 27*a*, the double-headed piston 29 is arranged to be located at the top dead center within the second compression chamber 28*a*, as shown in FIGS. 7A and 7B. The rotation angle of the rotary shaft 21 when the double-headed piston 29 is at the position of the top dead center within the second compression chamber 28*a*, that is, the rotation angle when the rotary shaft 21 rotates 180 degrees from the rotation angle when the double-headed piston 29 is located at the top dead center within the first compression chamber 27*a* is regarded as zero degrees (−180 degrees, see FIG. 4).

Figure 8A:
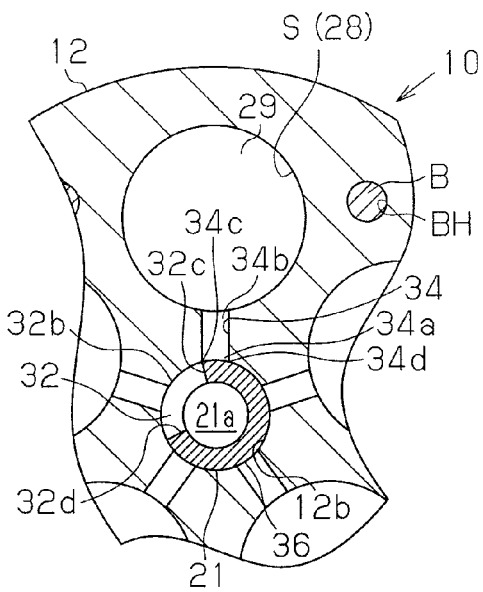
FIG. 8A is a longitudinal cross-sectional view of the second rotary valve when the double-headed piston is rotated by a predetermined angle from the top dead center in FIG. 7A.
Figure 8B:
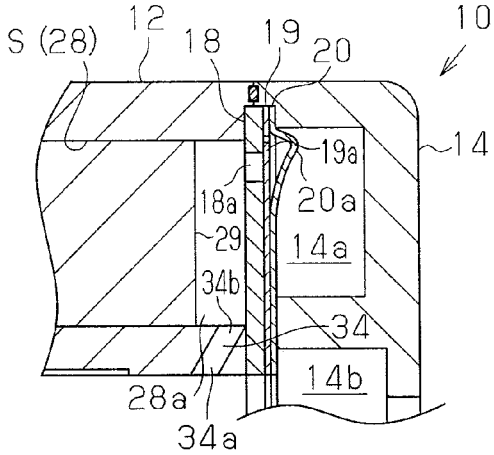
FIG. 8B is a transverse cross-sectional view of FIG. 8A.

When the rotary shaft 21 rotates by an angle θ2 from when the double-headed piston 29 is at the position of the top dead center within the second compression chamber 28*a* (the rotation angle of zero degrees (−180 degrees)), an end 34*c* of the inlet 34*a* of the second suction passage 34 is matched with the communication start end 32*c* of the second introduction passage 32, as shown in FIG. 8A. At this time, the second introduction passage 32 and the second suction passage 34 start to communicate with each other. That is, the relationship between the inlet 34*a* and the outlet 32*b* shown in FIG. 8A corresponds to the relationship between the inlet 34*a* shown by the broken line and the outlet 32*b* in FIG. 4. At this communication start timing, residual gas is expanded within the second compression chamber 28*a*, wherewith a pressure within the second compression chamber 28*a* is not more than a pressure in the shaft passage 21*a* which is a suction pressure zone. The timing when the second introduction passage 32 and the second suction passage 34 start to communicate with each other and the timing when the first introduction passage 31 and the first suction passage 33 start to communicate with each other are defined as a communication start timing, respectively.

In the first embodiment, the angle θ1 of the rotary shaft 21 is designed to be smaller than the angle θ2. Therefore, when the rotary shaft 21 rotates 180 degrees from when the inlet 33*a* of the first suction passage 33 is in a state of the communication start timing in the first rotary valve 35, the inlet 34*a* of the second suction passage 34 is not in a state of the communication start timing but is in a state prior to the communication start timing. The difference between the angle θ1 and the angle θ2 is preferably set to 2 to 15 degrees. When the difference is smaller than 2 degrees, there can be unfavorably a case where the difference in angle is not generated due to manufacturing errors of the first introduction passage 31 and the second introduction passage 32. On the other hand, when the difference is greater than 15 degrees, the communication start timing in the second compression chamber 28*a* is delayed drastically so that a suction amount of the refrigerant into the second compression chamber 28*a* is small. As a result, unfavorably, the compression efficiency of the second compression chamber 28*a* is exceedingly lowered as compared with when the communication start timing is not delayed.

The first rotary valve 35 has a part on a circumferential surface thereof, the part being opposed to the first suction passage 33 and most intruding into the first suction passage 33 when the double-headed piston 29 is located at the top dead center in the first compression chamber 27*a*, as shown in FIG. 5A. The part is defined as a top end T1. That is, the top end T1 of the first rotary valve 35 is a position of the first rotary valve 35 (the rotary shaft 21) corresponding to the top dead center of the piston 29 in the first compression chamber 27*a*. The length from the top end T1 of the first rotary valve 35 to the communication start end 31*c* of the first introduction passage 31 along the circumferential direction of the first rotary valve 35 (the rotary shaft 21) is denoted by K1.

As shown in FIG. 7A, the second rotary valve 36 has a part on a circumferential surface thereof, the part being opposed to the second suction passage 34 and most intruding the second suction passage 34 when the double-headed piston 29 is located at the top dead center in the second compression chamber 28*a*. The part is defined as a top end T2. That is, the top end T2 of the second rotary valve 36 is a position of the second rotary valve 36 (the rotary shaft 21) corresponding to the top dead center of the piston 29 in the second compression chamber 28*a*. The length from the top end T2 of the second rotary valve 36 to the communication start end 32*c* of the second introduction passage 32 along the circumferential direction of the rotary shaft 21 is denoted by K2. At this time, the first introduction passage 31 and the second introduction passage 32 are formed in the rotary shaft 21 such that the length K1 is shorter than the length K2. That is, the difference between the angle θ1 and the angle θ2 is generated by the difference between the length K1 and the length K2.

As shown in FIG. 6A, the first introduction passage 31 communicates with the first suction passage 33 at the communication start timing when the rotary shaft 21 rotates by the angle θ1 from when the double-headed piston 29 is at the position of the top dead center in the first compression chamber 27*a* (the rotation angle of the rotary shaft 21 is zero degrees) as shown in FIGS. 5A and 5B.

Pulsations occur at the communication start timing of the first compression chamber 27*a* in each cylinder bore pair S. Consequently, five times of pulsations occur in five first compression chambers 27*a* while the rotary shaft 21 makes one rotation. After the double-headed piston 29 reaches the bottom dead center in the first compression chamber 27*a*, the first compression chamber 27*a* is shifted to a compression stroke, whereupon the communication between the outlet 31*b* of the first introduction passage 31 and the inlet 33*a* of the first suction passage 33 is cut off. This is the timing when the end 33*d* of the inlet 33*a* of the first suction passage 33 shown in the two-dot chain line in FIG. 4 and the communication finish end 31*d* of the first introduction passage 31 are matched, that is, when the rotary shaft 21 rotates by θ3 (about 185 degrees) from when the double-headed piston 29 reaches the top dead center within the first compression chamber 27*a*. The timing is defined as communication finish timing.

When the rotary shaft 21 rotates 180 degrees from when the double-headed piston 29 is at the position of the top dead center in the first compression chamber 27*a*, the double-headed piston 29 is located at the top dead center in the second compression chamber 28*a* (the rotation angle of the rotary shaft 21 is zero degrees (−180 degrees)), as shown in FIGS. 7A and 7B. At the communication start timing when the rotary shaft 21 rotates by the angle θ2 from when the piston 29 is located at the top dead center in the second compression chamber 28*a*, the second introduction passage 32 communicates with the second suction passage 34, as shown in FIG. 8A.

In each cylinder bore pair S, pulsations occur at the communication start timing of the second compression chamber 28*a*. Therefore, five times of pulsations occur in five second compression chambers 28*a* while the rotary shaft 21 makes one rotation. After the double-headed piston 29 reaches the bottom dead center in the second compression chamber 28*a*, the second compression chamber 28*a* is shifted to a compression stroke, whereupon the communication between the outlet 32*b* of the second introduction passage 32 and the inlet 34*a* of the second suction passage 34 is cut off. This is the timing when the end 34*d* of the inlet 34*a* of the second suction passage 34 shown in the two-dot chain line in FIG. 4 and the communication finish end 32*d* of the second introduction passage 32 are matched, that is, when the rotary shaft 21 rotates by θ3 (about 185 degrees) from when the double-headed piston 29 reaches the top dead center within the second compression chamber 28*a*. The timing is defined as communication finish timing. A time period from the top dead center timing of the double-headed piston 29 in the first compression chamber 27*a* to the communication finish timing is equal to a time period from the top dead center timing of the double-headed piston 29 in the second compression chamber 28*a* to the communication finish timing. That is, when the rotary shaft 21 rotates 180 degrees from when the inlet 33*a* of the first suction passage 33 is at the communication finish timing in the first rotary valve 35, the inlet 34*a* of the second suction passage 34 is also at the communication finish timing.

Pulsations occur ten times, summing up pulsations occurring in the first compression chamber 27*a* and pulsations occurring in the second compression chamber 28*a*, while the rotary shaft 21 makes one rotation. As described above, the angle θ1 is smaller than the angle θ2. Accordingly, a time period (a first time period) from the top dead center timing of the double-headed piston 29 in the first compression chamber 27*a* to the communication start timing is shorter than a time period (a second time period) from the top dead center timing of the double-headed piston 29 in the second compression chamber 28*a* to the communication start timing, in each cylinder bore pair S. As a result, the communication start timing in the second compression chamber 28*a* comes later than the timing when the rotary shaft 21 rotates 180 degrees from the communication start timing in the first compression chamber 27*a*. That is, in each cylinder bore pair S, pulsations occur in the second compression chamber 28*a* later than the timing when the rotary shaft 21 rotates 180 degrees from the timing when pulsations occur in the first compression chamber 27*a*.

Figure 9A:
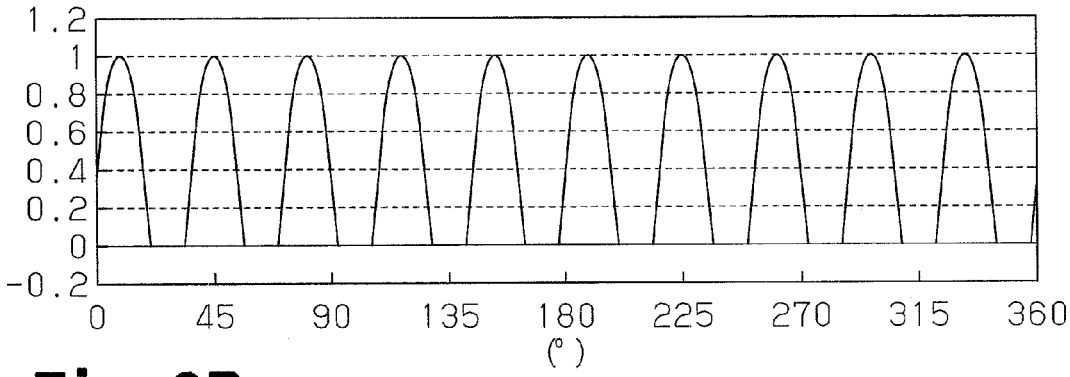
FIG. 9A is a waveform diagram of pulsations caused in the double-headed piston type compressor in accordance with the first embodiment.
Figure 9B:
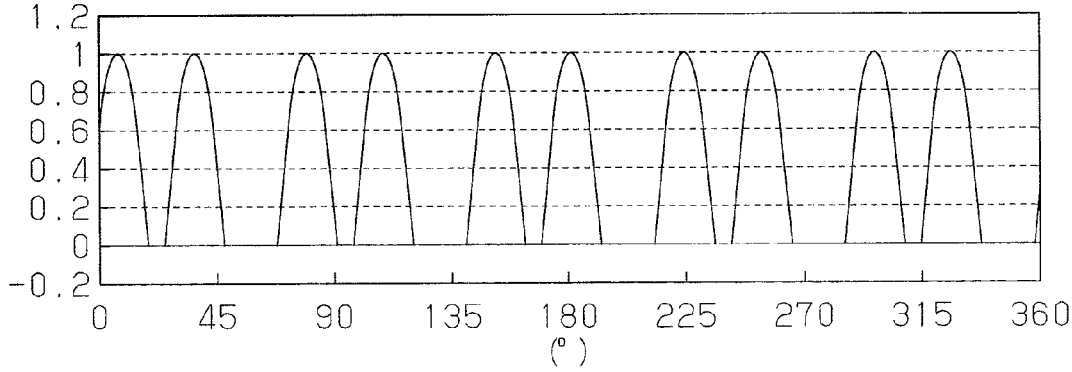
FIG. 9B is a waveform diagram of pulsations caused in a conventional double-headed piston type compressor.

In the graphs shown in FIGS. 9A and 9B, the axis of ordinates represents a pressure (MPa) within the suction chamber 14*b*, and the axis of abscissas represents a rotation angle (degree) of the rotary shaft 21. FIG. 9A illustrates pressure fluctuations within the suction chamber 14*b* occurring while the rotary shaft 21 makes one rotation (360 degrees) in the compressor 10 of the first embodiment. The pressure within the suction chamber 14*b* has ten cycles of fluctuations occurring at regular intervals while the rotary shaft 21 makes one rotation in the compressor 10 of the first embodiment. In other words, ten times of pressure fluctuations occur at regular intervals within the suction chamber 14*b* while the rotary shaft 21 makes one rotation in the compressor 10 of the first embodiment. That is, a pulsation waveform with a tenth-order component is produced.

On the other hand, FIG. 9B illustrates pressure fluctuations within a suction chamber occurring while a rotary shaft makes one rotation (360 degrees) in a conventional compressor with a time period from a top dead center timing in a first compression chamber to a communication start timing equalized with a time period from a top dead center timing in a second compression chamber to a communication start timing.

Regarding two times of pressure fluctuations as a set, in the conventional compressor, five sets of pressure fluctuations occur at regular intervals within the suction chamber while the rotary shaft 21 makes one rotation. That is, a pulsation waveform with a fifth-order component is produced. Therefore, the pulsation waveform of the conventional compressor is highly affected by the fifth-order component. By making a time period from the top dead center timing in the first compression chamber 27*a* to the communication start timing different from a time period from the top dead center timing in the second compression chamber 28*a* to the communication start timing as in the first embodiment, the pulsation waveform occurring while the rotary shaft 21 makes one rotation can be changed from the waveform with the fifth-order component to the waveform with the tenth-order component. Consequently, pulsations are small as compared with the conventional compressor in which a time period from the top dead center timing in the first compression chamber 27*a* to the communication start timing is equal to a time period from the top dead center timing in the second compression chamber 28*a* to the communication start timing. Additionally, the frequencies of the pulsations are different so that a resonance phenomenon in the piping 50 and 52 as external devices is suppressed.

According to the above-mentioned embodiment, advantages as described below are obtained.

(1) The time period from the top dead center timing of the double-headed piston 29 in the first compression chamber 27*a* to the communication start timing is different from the time period from the top dead center timing of the double-headed piston 29 in the second compression chamber 28*a* to the communication start timing in each cylinder bore pair S. That is, the angle θ1 of the rotary shaft 21 rotating from the top dead center timing in the first compression chamber 27*a* to the communication start timing is smaller than the angle θ2 of the rotary shaft 21 rotating from the top dead center timing in the second compression chamber 28*a* to the communication start timing. Accordingly, the time period from when the double-headed piston 29 reaches the top dead center in the second compression chamber 28*a* to when the second introduction passage 32 and the second suction passage 34 start to communicate with each other is longer than the time period from when the double-headed piston 29 reaches the top dead center in the first compression chamber 27*a* to when the first introduction passage 31 and the first suction passage 33 start to communicate with each other. Therefore, the order component of suction pulsations which indicate pressure fluctuations within the suction chamber 14*b* can be changed to change the frequencies of the pulsations. As a result, a match with resonant frequencies of the piping 50 and 52 as external devices is avoided, so that the occurrence of a resonance phenomenon in the external devices due to the suction pulsations is suppressed. Consequently, large noise is prevented from being caused in the passenger compartment.

(2) If the time period from the timing when the double-headed piston 29 reaches the top dead center in the second compression chamber 28*a* to the timing when the second introduction passage 32 and the second suction passage 34 start to communicate with each other is shorter than the time period from the timing when the double-headed piston 29 reaches the top dead center in the first compression chamber 27*a* to the timing when the first introduction passage 31 and the first suction passage 33 start to communicate with other, the following problem is caused. Although residual gas is expanded within the second compression chamber 28*a* at the communication start timing in the second compression chamber 28*a*, the pressure within the second compression chamber 28*a* is higher than the pressure within the shaft passage 21*a* which is a suction pressure zone. As a result, the residual gas in the second compression chamber 28*a* flows back to the shaft passage 21*a* after the communication start timing so that pulsations are unfavorably large.

Accordingly, in the first embodiment, the time period from the timing when the double-headed piston 29 reaches the top dead center in the second compression chamber 28*a* to the timing when the second introduction passage 32 and the second suction passage 34 start to communicate with each other is longer than the time period from the timing when the double-headed piston 29 reaches the top dead center in the first compression chamber 27*a* to the timing when the first introduction passage 31 and the first suction passage 33 start to communicate with each other in each cylinder bore pair S. In other words, the timing when the second introduction passage 32 and the second suction passage 34 start to communicate with each other is relatively delayed. Therefore, the pressure within the second compression chamber 28*a* is lower than the pressure within the shaft passage 21*a* which is a suction pressure zone at the communication start timing in the second compression chamber 28*a*. As a result, the residual gas in the second compression chamber 28*a* cannot flow back to the shaft passage 21*a*, whereupon pulsations are suppressed.

(3) The compressor 10 is of a rear side suction type, in which refrigerant is introduced from the suction chamber 14*b* formed in the rear housing member 14 to the first introduction passage 31 and the second introduction passage 32 via the shaft passage 21*a* of the rotary shaft 21. In a configuration where the refrigerant is drawn via the shaft passage 21*a* and each of the rotary valves 35 and 36 in the compressor 10, the swash plate chamber 24 cannot be used as a muffler. Consequently, the suction pulsations cannot be controlled by the muffler function. Furthermore, a resonance phenomenon resulting from the suction pulsations cannot be suppressed. According to the first embodiment, however, while the resonance phenomenon resulting from the suction pulsations is suppressed, the size of the compressor 10 is prevented from being enlarged as in a case where a muffler function is separately provided in the compressor 10.

(4) The lower limit of the difference between the angle η1 and the angle θ2 is set to 2 degrees. Consequently, a disadvantage that time periods from top dead center timings to communication start timings cannot be made different because of no significant angle differences due to manufacturing errors can be avoided. The upper limit of the difference between the angle θ1 and the angle θ2 is set to 15 degrees. Therefore, reduction in a suction amount of the refrigerant due to an excessively delayed communication start timing in the second introduction passage 32 relative to the second suction passage 34 is suppressed so that reduction of the compression efficiency is minimized, in the first embodiment.

Next, a second embodiment of the present invention is described with reference to FIG. 10. In the embodiments described below, like or the same reference numerals are given to those components that are like or the same as the corresponding components of the first embodiment, and detailed explanations are omitted or simplified.

Figure 10:
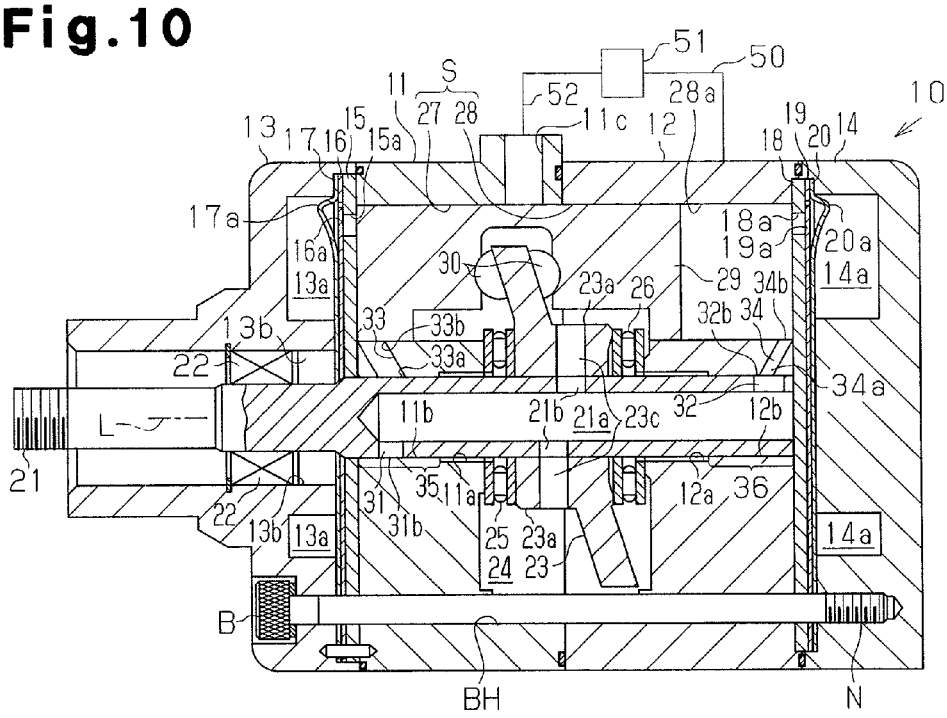
FIG. 10 is a longitudinal cross-sectional view of a double-headed piston type compressor in accordance with a second embodiment.

In the compressor 10, as shown in FIG. 10, the cylinder block 11 constituting a part of the compressor housing has a communication port 11*c* extending through a circumferential wall thereof so as to connect the swash plate chamber 24 with the external refrigerant circuit 51 (piping 52). On the base 23*a* of the swash plate 23, two introduction ports 23*c* extending in a radial direction of the swash plate 23 are formed. The rotary shaft 21 has communication passages 21*b* in positions communicating with each introduction port 23*c*. The swash plate chamber 24 and the shaft passage 21*a* are connected via the introduction ports 23*c* and the communication passages 21*b*. The suction chamber 14*b* is eliminated in the compressor 10 of the second embodiment. Refrigerant having passed through the external refrigerant circuit 51 is introduced into the swash plate chamber 24 via the communication port 11*c* and then into the shaft passage 21*a* via the introduction ports 23*c* and the communication passages 21*b* of the rotary shaft 21. The refrigerant within the shaft passage 21*a* is drawn into the first compression chamber 27*a* and the second compression chamber 28*a* from the corresponding first introduction passage 31 and second introduction passage 32 via the corresponding first suction passage 33 and second suction passage 34. That is, the refrigerant suction method of the compressor 10 of the second embodiment is a swash plate chamber suction method, and the swash plate chamber 24 and the shaft passage 21*a* constitute a suction pressure zone.

The angle θ1 of the rotary shaft 21 rotating from the top dead center timing in the first compression chamber 27*a* to the communication start timing is smaller than the angle θ2 of the rotary shaft 21 rotating from the top dead center timing in the second compression chamber 28*a* to the communication start timing. In the second embodiment, the time period from when the double-headed piston 29 reaches the top dead center in the first compression chamber 27*a* to when the first introduction passage 31 and the first suction passage 33 start to communicate with each other can be made longer than the time period from when the double-headed piston 29 reaches the top dead center in the second compression chamber 28*a* to when the second introduction passage 32 and the second suction passage 34 start to communicate with each other.

Therefore, according to the second embodiment, an advantage below is obtained in addition to the same advantages (1) to (4) in the first embodiment.

(5) Since the swash plate chamber 24 functions as a muffler chamber, pulsations occurring in the first and second compression chambers 27*a* and 28*a* are suppressed. Consequently, the occurrence of a resonance phenomenon in the external device is suppressed so that a significant contribution to silencing in the passenger compartment is made.

Each embodiment may be modified as follows.

Figure 11:
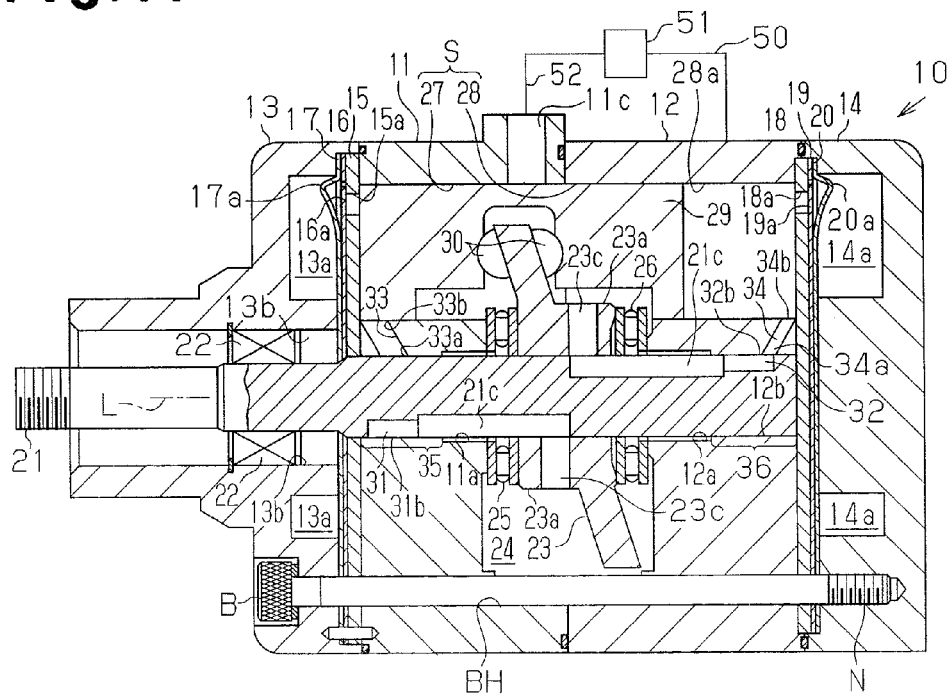
FIG. 11 is a longitudinal cross-sectional view of a double-headed piston type compressor in accordance with a modified embodiment.

As shown in FIG. 11, the cylinder block 11 constituting a part of the compressor housing in the compressor 10 has a communication port 11*c* extending through a circumferential wall thereof so as to connect the swash plate chamber 24 with the external refrigerant circuit 51 (piping 52). Additionally, two introduction ports 23*c* extending in the radial direction of the swash plate 23 are formed on the base 23*a* of the swash plate 23.

The rotary shaft 21 has respective communication grooves (communication passages) 21*c* in positions communicating with each introduction port 23*c*. The communication groove 21*c* at the front side of the two communication grooves 21*c* communicates with the first introduction passage 31 of the first rotary valve 35. The communication groove 21*c* at the rear side communicates with the second introduction passage 32 of the second rotary valve 36. In the compressor 10, the refrigerant is introduced from the swash plate chamber 24 into each introduction passage 31, 32 via the introduction ports 23*c* and the communication grooves 21*c* of the rotary shaft 21.

Figure 12A:
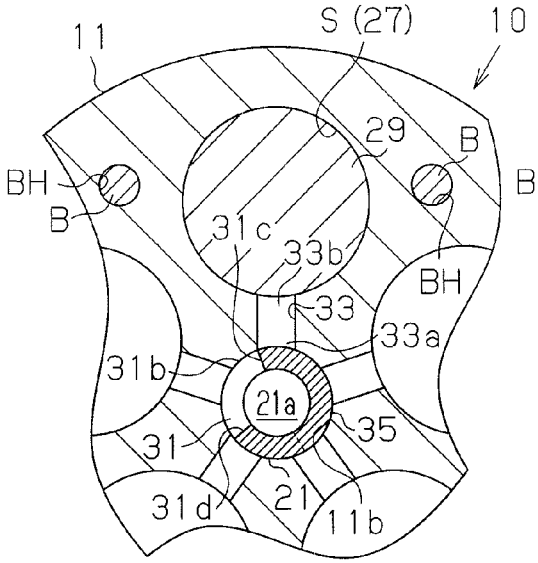
FIG. 12A is a cross-sectional view showing a first rotary valve and first suction passages of the compressor in accordance with a modified embodiment.
Figure 12B:
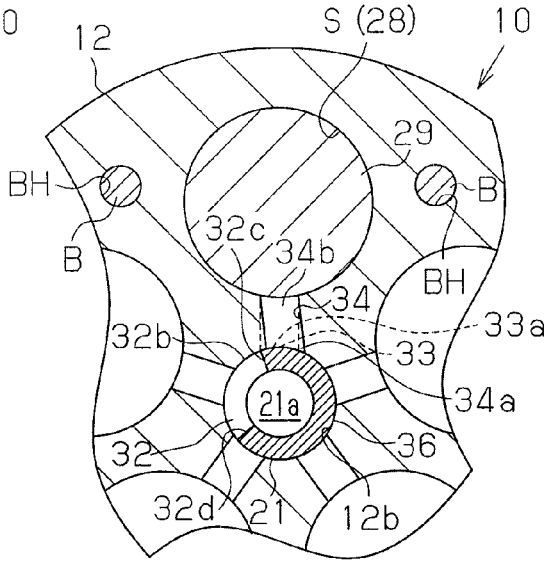
FIG. 12B is a cross-sectional view showing a second rotary valve and second suction passages of the compressor shown in FIG. 12A.

The length of the outlet 31*b* in the first introduction passage 31 may be equalized with the length of the outlet 32*b* in the second introduction passage 32 along the circumferential direction of the rotary shaft 21, and, in each cylinder bore pair S, one of the inlet 33*a* of the first suction passage 33 and the inlet 34*a* of the second suction passage 34 may be formed in a position displaced in the circumferential direction of the rotary shaft 21 relative to the other. As shown in FIGS. 12A and 12B, for example, the inlet 34*a* of the second suction passage 34 may be formed in a position displaced along a rotational direction of the rotary shaft 21 or the counter direction of the rotational direction of the rotary shaft 21 relative to the inlet 33*a* of the first suction passage 33. Alternatively, the length of the outlet 31*b* in the first introduction passage 31 may be different from the length of the outlet 32*b* in the second introduction passage 32 along the circumferential direction of the rotary shaft 21, and, in each cylinder bore pair S, one of the inlet 33*a* of the first suction passage 33 and the inlet 34*a* of the second suction passage 34 may be formed in a position displaced in the circumferential direction of the rotary shaft 21 relative to the other. When thus configured, too, after the double-headed piston 29 reaches the top dead center in each compression chamber 27*a*, 28*a*, the timings at which the first introduction passage 31 and the second introduction passage 32 start to communicate respectively with the first suction passage 33 and the second suction passage 34 can be made different.

In the first embodiment, the angle θ1 of the rotary shaft 21 from the top dead center timing in the first compression chamber 27*a* to the communication start timing may be larger than the angle θ2 of the rotary shaft 21 from the top dead center timing in the second compression chamber 28*a* to the communication start timing. The time period from when the double-headed piston 29 reaches the top dead center in the first compression chamber 27*a* to when the first introduction passage 31 and the first suction passage 33 start to communicate with each other may be shorter than the time period from when the double-headed piston 29 reaches the top dead center in the second compression chamber 28*a* to when the second introduction passage 32 and the second suction passage start to communicate with each other.

The length of the outlet 31*b* (the length from the communication start end 31*c* to the communication finish end 31*d*) in the first introduction passage 31 may be equalized with the length of the outlet 32*b* (the length from the communication start end 32*c* to the communication finish end 32*d*) in the second introduction passage 32 along the circumferential direction of the rotary shaft 21. A length K1 from the top end T1 of the first rotary valve 35 to the communication start end 31*c* of the first introduction passage 31 along the circumferential direction of the rotary shaft 21 may be shorter or longer than a length K2 from the top end T2 of the second rotary valve 36 to the communication start end 32*c* of the second introduction passage 32 along the circumferential direction of the rotary shaft 21. Additionally, the length K1 may be different from the length K2, and, in each cylinder bore pair S, one of the inlet 33*a* of the first suction passage 33 and the inlet 34*a* of the second suction passage 34 may be formed in a position displaced in the circumferential direction of the rotary shaft 21 relative to the other.

Although the first rotary valve 35 and the second rotary valve 36 are formed integrally with the rotary shaft 21, a first rotary valve 35 and a second rotary valve 36 that are separate from the rotary shaft 21 may be mounted on the rotary shaft 21 as long as the first and second rotary valves 35 and 36 are coupled with the rotary shaft 21 so as to be rotatable with the latter integrally.

The number of cylinder bore pairs S may be changed optionally.

What is claimed is:

1. A double-headed piston type compressor connected with an external device so as to constitute a refrigerant circuit, comprising:

a rotary shaft having a first end portion and a second end portion;

a compressor housing connected with the external device, wherein the compressor housing has a front portion rotatably supporting the first end portion of the rotary shaft, a rear portion rotatably supporting the second end portion of the rotary shaft, a swash plate chamber, a suction pressure zone communicating with the external device, and a plurality of cylinder bore pairs arranged around the rotary shaft, each of the cylinder bore pairs having a front cylinder bore and a rear cylinder bore;

double-headed pistons inserted into the plurality of cylinder bore pairs respectively so as to reciprocate, each of the double-headed pistons defining a first compression chamber within the front cylinder bore and a second compression chamber within the rear cylinder bore;

a swash plate rotating with the rotary shaft within the swash plate chamber and causing the double-headed pistons to reciprocate within the cylinder bore pairs;

a first rotary valve coupled with the rotary shaft so as to be rotatable with the rotary shaft integrally, and having a first introduction passage for introducing a refrigerant from the suction pressure zone into the first compression chambers;

a second rotary valve coupled with the rotary shaft so as to be rotatable with the rotary shaft integrally, and having a second introduction passage for introducing a refrigerant from the suction pressure zone into the second compression chambers;

first suction passages formed in the compressor housing so as to allow each of the first compression chambers to be connected with the first introduction passage; and second suction passages formed in the compressor housing so as to allow each of the second compression chambers to be connected with the second introduction passage, wherein, in each cylinder bore pair, a first time period from a first top dead center timing, which is timing when the double-headed piston reaches the top dead center in the first compression chamber, to a first communication start timing, which is timing when the first introduction passage starts to communicate with the first suction passage, is different from a second time period from a second top dead center timing, which is timing when the double-headed piston reaches the top dead center in the second compression chamber, to a second communication start timing, which is timing when the second introduction passage starts to communicate with the second suction passages.

2. The compressor according to claim 1, wherein, in each cylinder bore pair, a range of rotation angle at which the rotary shaft rotates from when the double-headed piston reaches the top dead center in the first compression chamber to when the first introduction passage starts to communicate with the first suction passage is different from a range of rotation angle at which the rotary shaft rotates from when the double-headed piston reaches the top dead center in the second compression chamber to when the second introduction passage starts to communicate with the second suction passage.

3. The compressor according to claim 1, wherein each in each cylinder bore pair, the first introduction passage has an outlet provided with a first communication start end, at which communication with the first suction passage is started first in a rotational direction of the rotary shaft, wherein the second introduction passage has an outlet provided with a second communication start end, at which communication with the second suction passage is started first in a rotational direction of the rotary shaft, and wherein, in each cylinder bore pair, a length to the first communication start end from a top end on a circumferential surface of the first rotary valve, which top end is in a position opposed to the first suction passage at the first top dead center timing, is different from a length to the second communication start end from a top end on a circumferential surface of the second rotary valve, which top end is in a position opposed to the second suction passage at the second top dead center timing.

4. The compressor according to claim 1, wherein, in the first and second suction passages communicating with each cylinder bore pair, one of a refrigerant inlet of the first suction passage and a refrigerant inlet of the second suction passage is arranged displaced in a circumferential direction of the rotary shaft relative to the other.

5. The compressor according to claim 1, wherein a pressure within each first compression chamber is not more than a pressure within the suction pressure zone at the first communication start timing due to expansion of residual gas, and wherein the second time period is longer than the first time period in each cylinder bore pair.

6. The compressor according to claim 1, wherein, in each cylinder bore pair, a difference between a range of rotation angle at which the rotary shaft rotates from when the double-headed piston reaches the top dead center in the first compression chamber to when the first introduction passage starts to communicate with the first suction passage and a range of rotation angle at which the rotary shaft rotates between from the double-headed piston reaches the top dead center in the second compression chamber to when the second introduction passage starts to communicate with the second suction passage is set to 2 to 15 degrees.

7. The compressor according to claim 1, wherein the suction pressure zone includes a suction chamber formed in the rear portion of the compression housing and a shaft passage extending within the rotary shaft, and wherein the refrigerant is introduced from the suction chamber into the first introduction passage and the second introduction passage via the shaft passage.

8. The compressor according to claim 1, wherein the suction pressure zone includes the swash plate chamber and a communication passage formed in the rotary shaft, and wherein the refrigerant is introduced from the swash plate chamber into the first introduction passage and the second introduction passage via the communication passage.

9. The compressor according to claim 1, wherein a cross-sectional area of the first suction passage is larger than that of the second suction passage.

10. A double-headed piston type compressor connected with an external device so as to constitute a refrigerant circuit, comprising:

a rotary shaft having a first end portion and a second end portion;

a compressor housing connected with the external device, wherein the compressor housing has a front portion rotatably supporting the first end portion of the rotary shaft, a rear portion rotatably supporting the second end portion of the rotary shaft, a swash plate chamber, a suction pressure zone communicating with the external device, and a plurality of cylinder bore pairs arranged around the rotary shaft, each of the cylinder bore pairs having a front cylinder bore and a rear cylinder bore;

double-headed pistons inserted into the plurality of cylinder bore pairs respectively so as to reciprocate, each of the double-headed pistons defining a first compression chamber within the front cylinder bore and a second compression chamber within the rear cylinder bore;

a swash plate rotating with the rotary shaft within the swash plate chamber and causing the double-headed pistons to reciprocate within the cylinder bore pairs;

a first rotary valve coupled with the rotary shaft so as to be rotatable with the rotary shaft integrally, and having a first introduction passage for introducing a refrigerant from the suction pressure zone into the first compression chambers;

a second rotary valve coupled with the rotary shaft so as to be rotatable with the rotary shaft integrally, and having a second introduction passage for introducing a refrigerant from the suction pressure zone into the second compression chambers;

first suction passages formed in the compressor housing so as to allow each of the first compression chambers to be connected with the first introduction passage; and second suction passages formed in the compressor housing so as to allow each of the second compression chambers to be connected with the second introduction passage, wherein, in each cylinder bore pair, a range of rotation angle at which the rotary shaft rotates from when the double-headed piston reaches the top dead center in the first compression chamber to when the first introduction passage starts to communicate with the first suction passage is different from a range of rotation angle at which the rotary shaft rotates from when the double-headed piston reaches the top dead center in the second compression chamber to when the second introduction passage starts to communicate with the second suction passage.

* * * * *